US011548756B2

(12) United States Patent
Pearson

(10) Patent No.: US 11,548,756 B2
(45) Date of Patent: Jan. 10, 2023

(54) SELF-RETRACTING REEL

(71) Applicant: IMAGINATION PLASTICS LLC, Duluth, MN (US)

(72) Inventor: Nathaniel Pearson, Duluth, MN (US)

(73) Assignee: Imagination Plastics LLC, Duluth, MN (US)

( * ) Notice: Subject to any disclaimer, the term of this patent is extended or adjusted under 35 U.S.C. 154(b) by 0 days.

(21) Appl. No.: 17/687,841

(22) Filed: Mar. 7, 2022

(65) Prior Publication Data

US 2022/0185621 A1 Jun. 16, 2022

Related U.S. Application Data

(62) Division of application No. 16/601,679, filed on Oct. 15, 2019, now Pat. No. 11,299,368.

(60) Provisional application No. 62/745,608, filed on Oct. 15, 2018.

(51) Int. Cl.

| | |
|---|---|
| ***B65H 75/48*** | (2006.01) |
| ***B65H 75/40*** | (2006.01) |
| ***B65H 75/44*** | (2006.01) |

(52) U.S. Cl.

CPC ..... *B65H 75/48* (2013.01); *B65H 75/406* (2013.01); *B65H 75/4418* (2013.01); *B65H 75/4471* (2013.01); *B65H 2701/33* (2013.01); *B65H 2701/34* (2013.01); *B65H 2701/35* (2013.01); *B65H 2701/37* (2013.01)

(58) Field of Classification Search

CPC .... B65H 75/48; B65H 75/406; B65H 75/486; B65H 75/4418; B65H 2701/33; B65H 2701/34; B65H 2701/35; B65H 2701/37

See application file for complete search history.

(56) References Cited

U.S. PATENT DOCUMENTS

| | | | | |
|---|---|---|---|---|
| 11,299,368 | B2 * | 4/2022 | Pearson | B65H 75/4418 |
| 2010/0084500 | A1 | 4/2010 | Inman | |
| 2011/0095120 | A1 | 4/2011 | Inman | |
| 2014/0263801 | A1 | 9/2014 | Skowronski | |
| 2016/0012941 | A1 | 1/2016 | Ledwith | |
| 2017/0260021 | A1 | 9/2017 | Hale | |
| 2018/0222715 | A1 | 8/2018 | Hall | |

* cited by examiner

*Primary Examiner* — Sang K Kim

(74) *Attorney, Agent, or Firm* — Dicke, Billig & Czaja, PLLC

(57) ABSTRACT

A retractable reel system includes a reel, a gear assembly, a paddle wheel and a spring. The reel includes a concentric wheel shaft where the reel and wheel shaft rotate to wind and unwind a length of material from the reel. The gear assembly engages with an end of the wheel shaft to provide a gear reduction ratio between the wheel shaft and an output shaft of the gear assembly. The paddle wheel is connected to and concentric with the output shaft, and the paddle wheel includes a paddle that extends beyond an outer edge of the paddle wheel that rotates with the paddle wheel. The spring is arranged outside the outer edge of the paddle wheel. The spring is compressed by the paddle to store an energy when the reel is rotated to unwind the length of material from the reel. The stored energy is used to rotate the reel to wind the length of material around the reel.

20 Claims, 18 Drawing Sheets

SELF-RETRACTING REEL

CROSS-REFERENCE TO RELATED APPLICATION

This application is a divisional application of U.S. Ser. No. 16/601,679, filed Oct. 15, 2019, which claims the benefit of U.S. Ser. No. 62/745,608, filed Oct. 15, 2018, both of which are herein incorporated by reference.

FIELD OF TECHNOLOGY

The present application relates to a self-retracting reel, in particular, a self-retracting reel with a gear assembly that provides a gear reduction ratio between the reel and an output shaft of the gear assembly, wherein a paddle wheel connected to the output shaft rotates to compress a spring to store an energy when the reel is rotated to unwind a length of material from the reel, and wherein the stored energy is used to rotate the reel to wind the length of material back around the reel.

BACKGROUND

Current self-retractable reel designs use a spiral spring. Spiral springs are a type of spring made from rectangular metal strips that have been wound into a flat spiral. Spiral springs are engineered to store and release rotational energy in the form of torque. The metal strip slides over itself and expands while it rotates. This creates the torque that rotates the reel back into place. However, the material and the machines used to make these kinds of springs are not easy to acquire. Another limitation of spiral springs is that the metal material used to manufacture the spiral springs is very thin and is known to harden over time. As a consequence, spiral springs lose their elasticity and ability to store and release rotational energy.

Another type of self-retractable reel design is commonly used in seat belts. This design uses a spring that is wrapped in a spiral much like the arms of a galaxy. They are similar to the spiral spring design discussed above, but these springs are much thicker and don't slide over themselves. As the seat belt is extended, the spring expands outward and this provides the rotational energy to spin the reel back and retract the seat belt.

Another applications for retractable reel designs exist for electrical cords and pneumatic air hoses. Since the electrical cords and pneumatic air hoses are heavy and bulky, current reel designs utilize electrical motors for retraction of the extension cords or pneumatic air hoses.

For these and other reasons, there is a need for the present invention.

SUMMARY

According to an embodiment of a retractable reel system, the system includes a reel, a gear assembly, a paddle wheel and a spring. The reel includes a concentric wheel shaft where the reel and wheel shaft rotate to wind and unwind a length of material from the reel. The gear assembly engages with an end of the wheel shaft to provide a gear reduction ratio between the wheel shaft and an output shaft of the gear assembly. The paddle wheel is connected to and concentric with the output shaft, and the paddle wheel includes a paddle that extends beyond an outer edge of the paddle wheel that rotates with the paddle wheel. The spring is arranged outside the outer edge of the paddle wheel. The spring is compressed by the paddle to store an energy when the reel is rotated to unwind the length of material from the reel. The stored energy is used to rotate the reel to wind the length of material around the reel.

According to an embodiment of a retractable electrical cord system, the system includes a reel, a gear assembly, a cartridge and a spring assembly and a slip ring and blade assembly. The reel includes a concentric wheel shaft where the reel and wheel shaft rotate to wind and unwind a length of the electrical cord that is wound around the reel. The gear assembly provides a gear reduction ratio between the wheel shaft and an output shaft of the gear assembly. The cartridge and a spring assembly includes a paddle wheel connected to and concentric with the output shaft, where the paddle wheel including a paddle that extends beyond an outer edge of the paddle wheel and rotates with the paddle wheel. A spring is arranged outside the outer edge of the paddle wheel and is compressed by the paddle to store an energy when the reel is rotated to unwind the length of extension cord from the reel. The spring is decompressed to use the stored energy to rotate the reel to wind the length of extension cord around the reel. The slip ring and blade assembly includes slip rings that each are concentric with and rotate with the wheel shaft and are electrically connected to the electrical cord. The slip ring and blade assembly includes blades that each include a contact bar that electrically contacts a corresponding slip ring and the blades are electrically connected to an extension cord that is separate from the electrical cord.

According to an embodiment of a retractable electrical cord system, the system includes an outer case, a reel, a gear assembly, a cartridge and spring assembly and a slip ring and blade assembly. The reel is mounted inside the outer case and includes a concentric wheel shaft. The reel and wheel shaft rotate to wind and unwind a length of the electrical cord that is wound around the reel and includes a female plug. The gear assembly is mounted inside the outer case and provides a gear reduction ratio between the wheel shaft and an output shaft of the gear assembly. The cartridge and spring assembly is mounted inside the outer case and includes a paddle wheel connected to and concentric with the output shaft. The paddle wheel includes a paddle that extends beyond an outer edge of the paddle wheel that rotates with the paddle wheel. A spring is arranged outside the outer edge of the paddle wheel and is compressed by the paddle to store an energy when the reel is rotated to unwind the length of electrical cord from the reel. The spring is decompressed to use the stored energy to rotate the reel to wind the length of electrical cord around the reel. The slip ring and blade assembly includes slip rings mounted to the wheel shaft that each are concentric with and rotate with the wheel shaft. The slip rings are electrically connected to electrical cord wires within the electrical cord. The blade assembly is mounted inside the outer case and includes blades that each include a contact bar that electrically contacts a corresponding slip ring. The blades are electrically connected to a corresponding extension cord wire within an extension cord. The extension cord extends through an opening in the outer case and including a male plug that is exterior to the outer case.

Those skilled in the art will recognize additional features and advantages upon reading the following detailed description, and upon viewing the accompanying drawings.

BRIEF DESCRIPTION OF THE DRAWINGS

The elements of the drawings are not necessarily to scale relative to each other. Like reference numerals designate corresponding similar parts. The features of the various illustrated embodiments can be combined unless they exclude each other. Embodiments are depicted in the drawings and are detailed in the description which follows.

DETAILED DESCRIPTION

Figure 1:
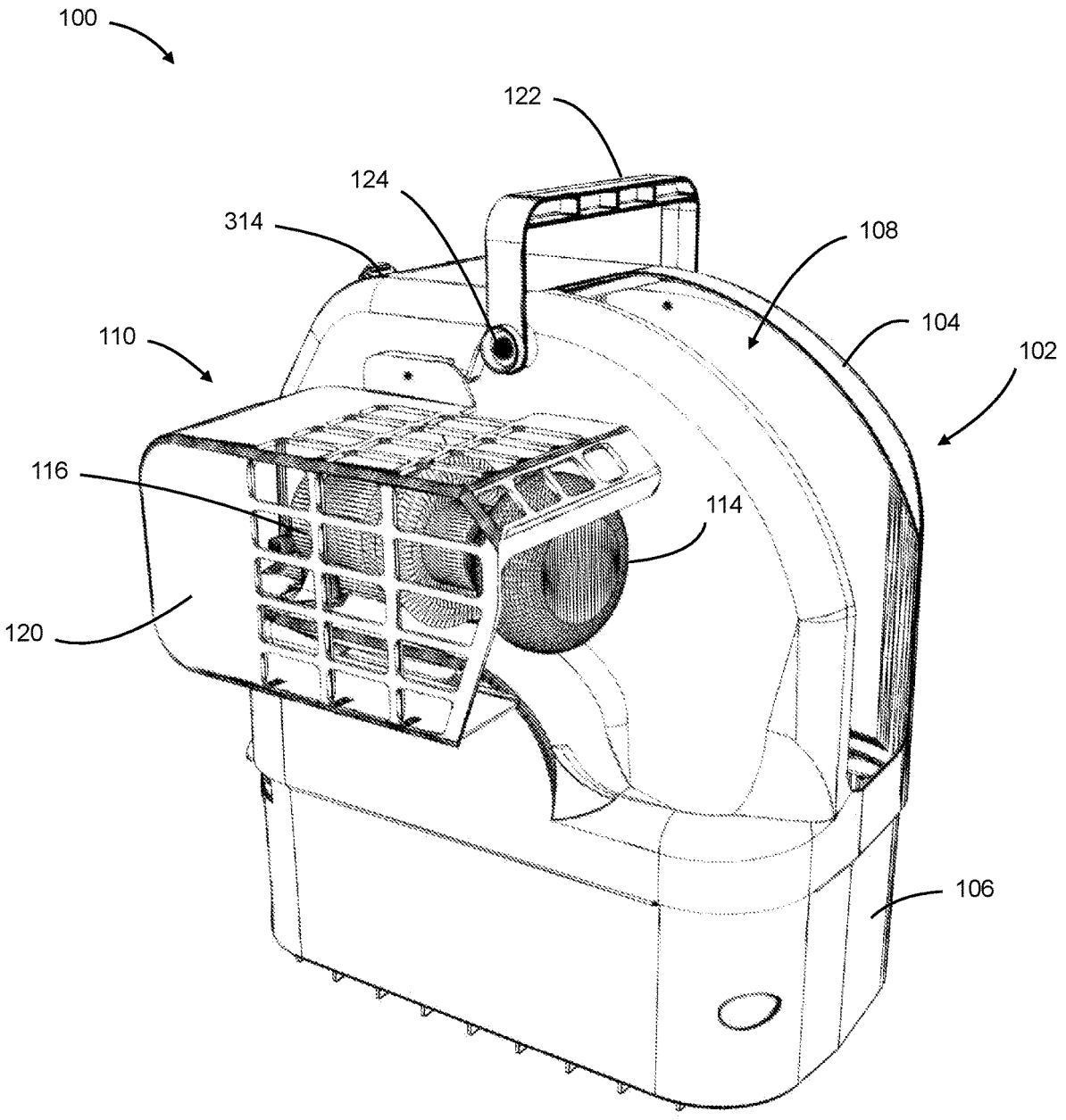
FIG. 1 illustrates a perspective view of an embodiment of retractable reel system.

FIG. 1 illustrates a perspective of an embodiment of retractable reel system at 100. The retractable reel system 100 includes an outer case 102 that includes an upper portion 104 and a lower portion 106. In various embodiments, outer case 102 including upper portion 104 and lower portion 106 can formed or manufactured from a variety of suitable materials that include, but are not limited to, ABS plastic, PLA, polyamide (nylon), glass filled polyamide, stereolithography materials (epoxy resins), silver, titanium, steel, wax, photopolymers and polycarbonate. In various embodiments, outer case 102 can be manufactured using a variety of suitable processes that include, but are not limited to, 3D printing.

In the illustrated embodiment, upper portion 104 of outer case 102 includes a slot 108 from which a length of material 202 can extend through for winding and unwinding from a reel 302 (see also, FIGS. 2-7). In various embodiments, the material can include, but is not limited to, an electrical cord, a pneumatic hose, a water hose, a leash or a measuring tape. The retractable reel system 100 also includes a gear assembly 402, a cartridge and spring assembly 404 and a slip ring and blade assembly 502 that are housed within outer case 102 (see also, FIGS. 3-18).

In the illustrated embodiment, retractable reel system 100 includes an accessory light 110 that is mounted to an exterior of the outer case 102. The accessory light 110 is electrically connected to the slip ring and blade assembly 502 (see also, FIG. 5). Accessory light 110 includes a bulb 114 and a socket 116 and is switchable on and off via a switch 118 (see also, FIG. 2). Accessory light 110 also includes a protective cover 120. In other embodiments, retractable reel system 100 does not include accessory light 110. Retractable reel system 100 includes a handle 122 that is attached to outer case 102 via a connection joint at 124.

Figure 2:
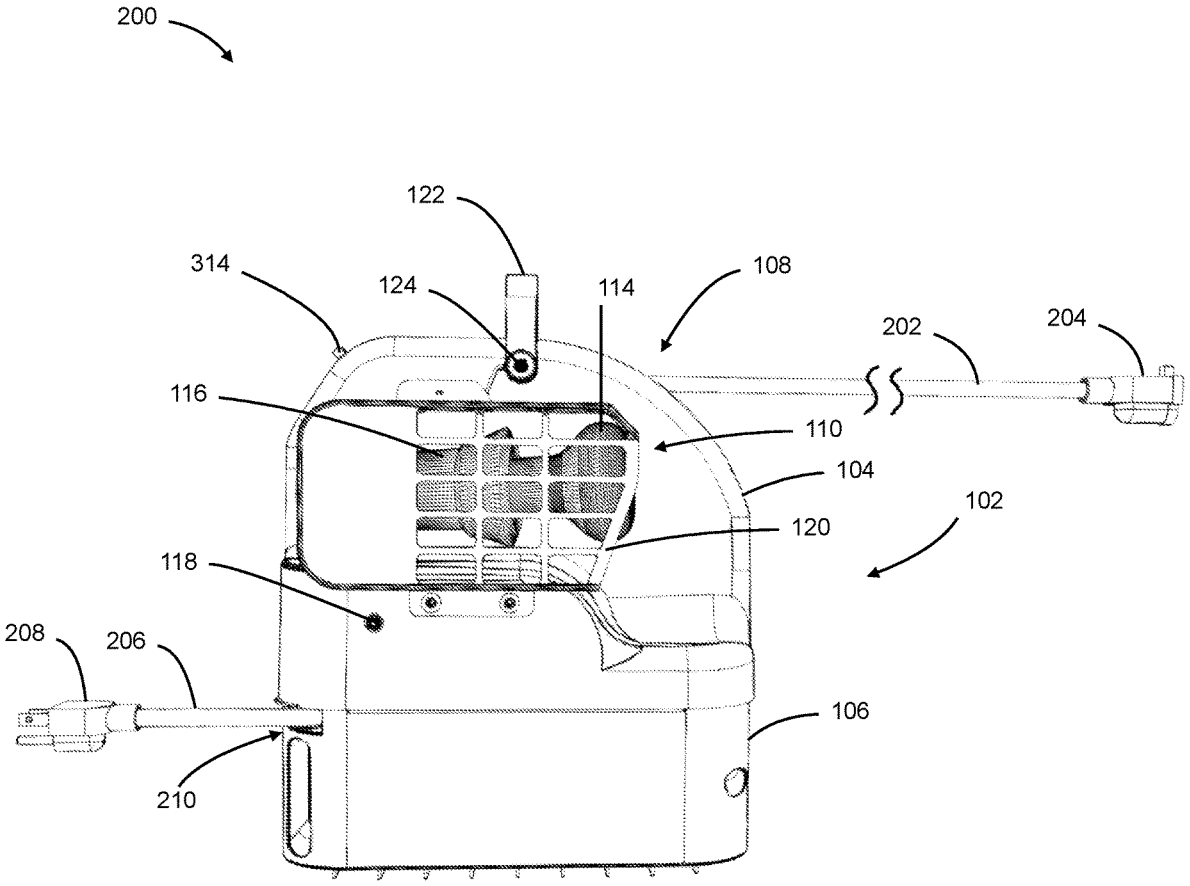
FIG. 2 illustrates a side view of an embodiment of a retractable reel system.

FIG. 2 illustrates a side view of an embodiment of the retractable reel system at 200. The embodiment of the retractable reel system 200 illustrated in FIG. 2 is the same as the embodiment illustrated in FIG. 1 but retractable reel system 200 in FIG. 2 further illustrates a length of material which is an electrical cord 202 that extends through slot 108 in upper portion 104 of outer case 102. Electrical cord 202 includes a female plug 204 at an end away from slot 108. Extension cord 206 extends through an opening 210 in outer case 102 and includes a male plug 208 that is exterior to the outer case 102. Retractable reel system 100 also includes electrical cord 202, female plug 204, extension cord 206 and male plug 208 although they are not illustrated in FIG. 1.

Figure 3:
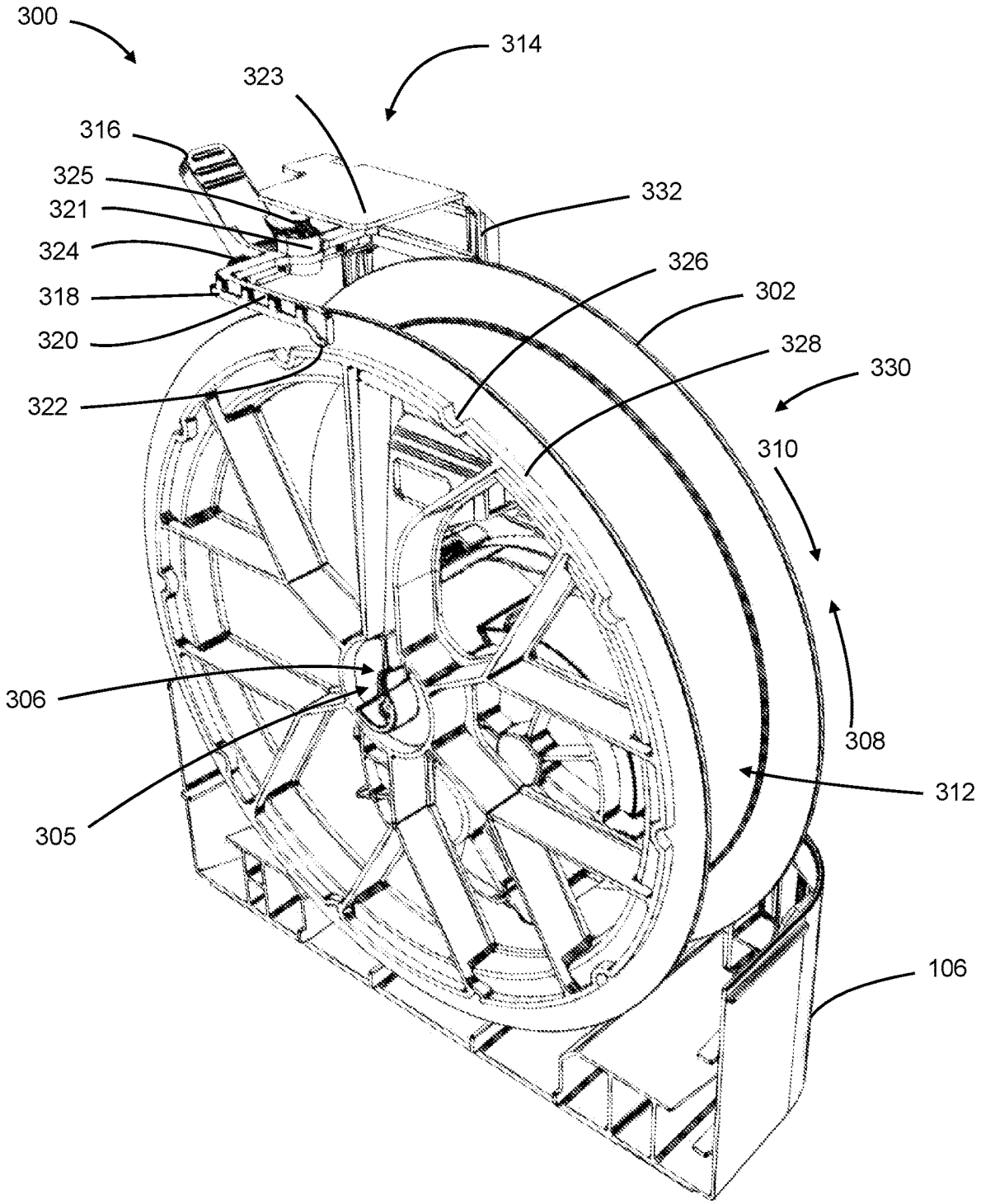
FIG. 3 illustrates a perspective cross-sectional view of an embodiment of an assembled cartridge for a retractable reel system.

FIG. 3 illustrates a perspective cross-sectional view of an embodiment of an assembled cartridge at 300 for a retractable reel system 100. In the illustrated embodiment, a reel 302 is mounted inside the lower portion 106 of outer case 102. Reel 302 includes a concentric wheel shaft 306, where reel 302 and wheel shaft 306 rotate together to wind in direction 308 and unwind in direction 310 a length of material such as an electrical cord 202. Electrical cord 202 is wound around reel 302 within a channel 312 of reel 302. Arrow 308 indicates a direction of rotation for reel 302 in which a length of material or electrical cord 302 is wound onto the reel 302 within channel 312, and arrow 310 indicates a direction of rotation of reel 302 in which a length of electrical cord is unwound from reel 302.

In the illustrated embodiment, a reel brake 314 includes a handle lever 316 attached to a base 318 of a u-shaped apparatus 320. Reel brake 314 is held in place and supported by support element 332 which is attached to a lower portion 106 of outer case 102. U-shaped apparatus 320 includes downward facing protrusions 322 at both ends of u-shaped apparatus 320. Reel brake 314 pivots along an axis provided by a shoulder screw 324 in a direction that is transverse to a direction of rotation of reel 302 (e.g., as shown by arrows 308 or 310). Shoulder screw 324 is located between handle lever 316 and base 318 of the u-shaped apparatus 320. Reel brake 314 engages or disengages the downward facing protrusions 322 from upward facing notches 326 on opposing exterior sides 328 and 330 of the reel 302. In the illustrated embodiment, the opposing exterior sides 328 and 330 include circumferential upward facing surfaces, where 10 notches 326 are built into each of the upward facing surfaces on opposing exterior sides 328 and 330. While 10 notches are utilized in the illustrated embodiment on each opposing exterior side 328 and 330, in other embodiments, any suitable number of notches can be used. In the illustrated embodiment, the upward facing notches 326 face away from wheel shaft 306 in a direction that is radial to wheel shaft 306 and the direction of rotation of reel 302 in directions 308 or 310.

Figure 4:
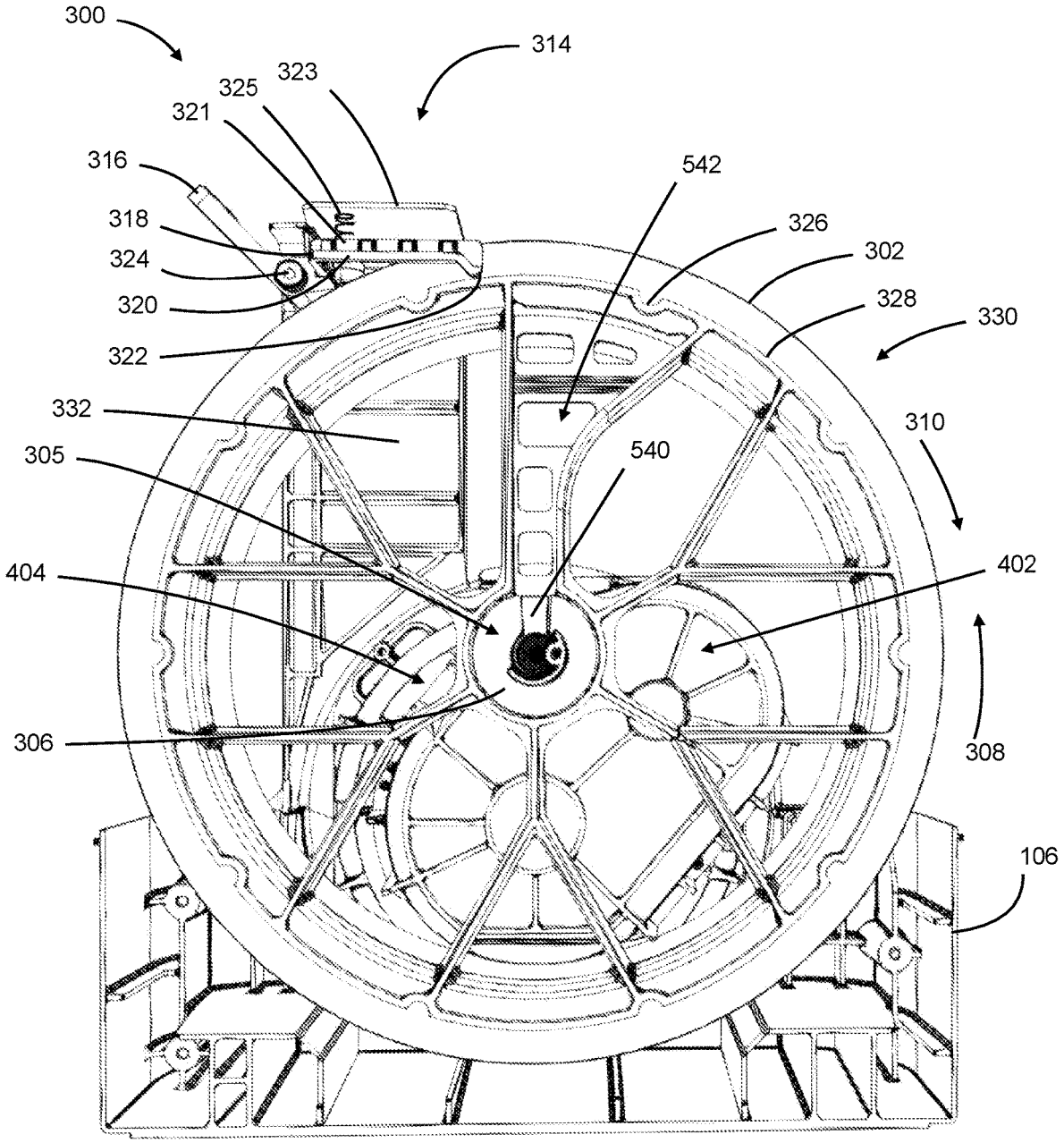
FIG. 4 illustrates a side cross-sectional side view of an embodiment of an assembled cartridge for a retractable reel system.

In the illustrated embodiment, reel brake 314 includes a spring holder 321 on the u-shaped apparatus 320 side of shoulder screw 324, a top 323 that is over the u-shaped apparatus 320, and a spring 325 between top 323 and spring holder 321. Spring 325 acts to bias protrusions 322 to engage the upward facing notches 326 on the opposing exterior sides 328 and 330 of the reel 302 to act as a brake and stop the rotation of reel 302 in directions 308 and 310. Once handle lever 316 is depressed to rotate u-shaped apparatus 320 upward to compress spring 325 and disengage the downward facing protrusions 322 from upward facing notches 326 on the opposing exterior sides 328 and 330 of the reel 302, the reel 302 can be rotated in directions 308 or 310 to wind or unwind the length of material or electrical cord 202. In some embodiments, the force or bias provided by spring 325 is small enough that reel 302 may be rotated in direction 310 to unwind the length of material or electrical cord 202 if a sufficient amount of force is used to pull the electrical cord 202 away from the reel 302 to unwind electrical cord 202. FIGS. 3 and 4 illustrate the downward facing protrusions 322 disengaged or not engaged with the upward facing notches 326 on opposing exterior sides 328 and 330 of the reel 302, and FIG. 5 illustrates illustrate the downward facing protrusions 322 engaged in upward facing notches 326 on opposing exterior sides 328 and 330 of the reel 302.

FIG. 4 illustrates a side cross-sectional side view of the embodiment of an assembled cartridge 300 shown in FIG. 3 for a retractable reel system 100. The assembled cartridge 300 includes a gear assembly 402 and a cartridge and spring assembly 404 that are located behind reel 302 in the cross-sectional view of FIG. 4.

Figure 5:
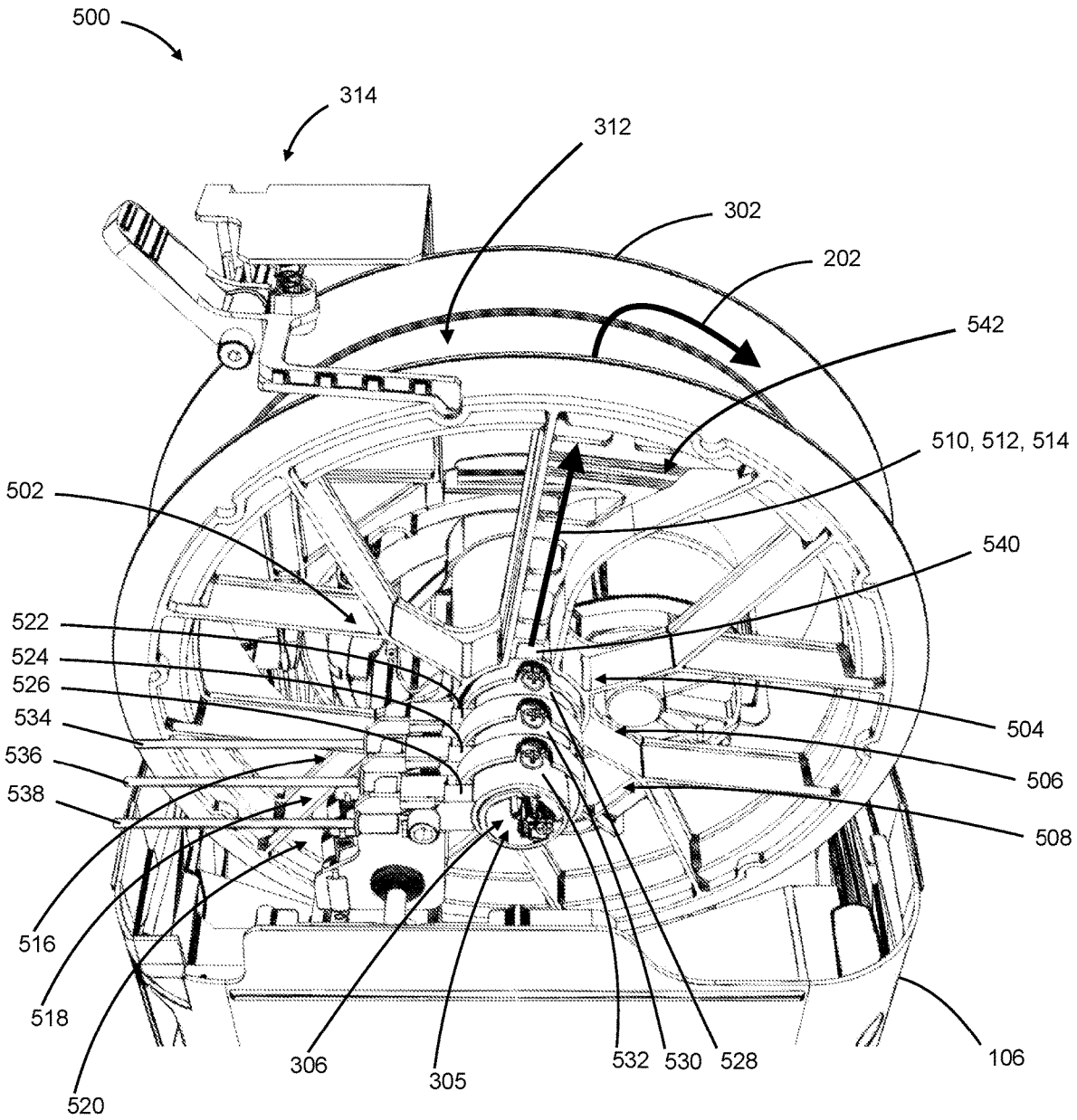
FIG. 5 illustrates a perspective view of an embodiment of a slip ring and blade assembly and a reel brake for a retractable reel system.

FIG. 5 illustrates a perspective view of an embodiment of a slip ring and blade assembly 502 and a reel brake 314 for a retractable reel system 100. FIGS. 3-5 represent an embodiment of a retractable reel system 100 where gear assembly 402 and a cartridge and spring assembly 404 are located behind reel 302 and a slip ring and blade assembly 502 is located in front of reel 302 in the perspective shown in FIG. 5, where the length of material or electrical cord 202 is unwound to the right side of FIG. 5. In other embodiments, slip ring and blade assembly 502, the gear assembly 402 and the cartridge and spring assembly 404 can be located on a same side of reel 302, or can be located on opposite sides of reel 302 where slip ring and blade assembly 502 is located behind reel 302 and the gear assembly 402 and the cartridge and spring assembly 404 are located in front of reel 302.

The slip ring and blade assembly 502 illustrated in FIG. 5 includes slip rings 504, 506 and 508 mounted to the wheel shaft 306, where slip rings 504, 506 and 508 are concentric with and rotate with the wheel shaft 306. Slip rings 504, 506 and 508 are electrically connected to electrical cord wires 510, 512 and 514 within the electrical cord 202.

The slip ring and blade assembly 502 is mounted inside the outer case 102, and includes blades 516, 518 and 520 that each include a corresponding contact bar 522, 524 and 526 that electrically contacts a corresponding rotor ring 528, 530 and 532 that are electrically connected to a corresponding extension cord wire 534, 536 and 538 within extension cord 206. In various embodiments, blades 516, 518 and 520 can be formed from any suitable material such as copper.

In the embodiment illustrated in FIG. 5, the three slip rings 504, 506 and 508 are arranged side-by-side on the wheel shaft 306. Each slip ring 504, 506 and 508 includes a rotor 802, a conductive rotor ring 528, 530 and 532 over a portion of the rotor, where the rotor rings 528, 530 and 532 are concentric with the wheel shaft 306. Each slip ring 504, 506 and 508 includes a retaining screw 702, 704 and 706 that secures the rotor ring 528, 530 and 532 to the rotor 802 to provide a conductive contact between each rotor ring 528, 530 and 532 and a terminal electrically connected to one of the positive electrical cord wire 510, the negative electrical cord wire 512 or the ground electrical cord wire 514 within the electrical cord 202.

In the illustrated embodiment, extension cord wire 534 is a positive electrical cord wire 534, extension cord wire 536 is a negative extension cord wire 536 and extension cord wire 538 is a ground extension cord wire 538 within extension cord 206. In this embodiment, slip rings 504, 506 and 508, and corresponding blades 516, 518 and 520, correspond to and conduct between the positive electrical cord wire 510 and positive extension cord wire 534, the negative electrical cord wire 512 and the negative extension cord wire 536, and the ground electrical cord wire 514 and the ground extension cord wire 538, respectively. In other embodiments, the order of rings 504, 506 and 508 and corresponding blades 516, 518 and 520 with respect to positive, negative and ground electrical cord wires 510, 512 and 514 and extension cord wires 534, 536 and 538 can have any suitable order or arrangement.

In the illustrated embodiment, for each of the slip rings 504, 506 and 508, a rotor 802 holds the conductive rotor ring 528, 530 and 532 in place. Each retaining screw 702, 704 and 706 holds a ring terminal in place underneath (not shown). When the retaining screws 702, 704 and 706 are secured or tightened, they provide a good electrical contact from each conductive rotor ring 528, 530 and 532 to the corresponding ring terminal and the corresponding one of the positive electrical cord wire 510, the negative electrical cord wire 512 or the ground electrical cord wire 514 within the electrical cord 202. Each of the positive electrical cord wire 510, the negative electrical cord wire 512 and the ground electrical cord wire 514 connects to the ring terminal for one of the conductive rotor rings 528, 530 and 532 and is routed through a center opening 804 of the rotor 802, into slot 540 within wheel shaft 306, and up through channel 542 and through opening 1102 within reel 302 and is routed and wound around reel 302 as electrical cord 202 in the direction illustrated in FIG. 5 for electrical cord 202 (see also, FIG. 11C).

Figure 6A:
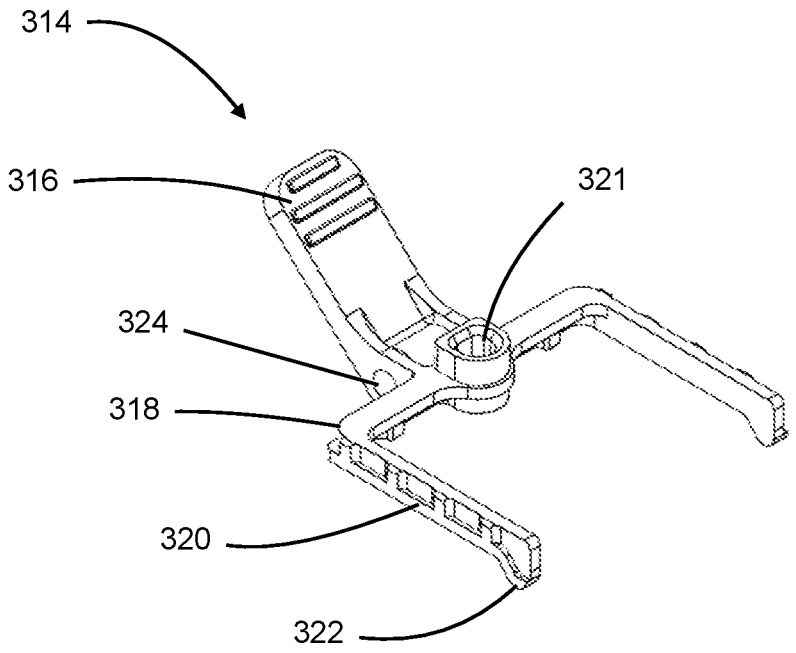
FIGS. 6A-6B illustrate views of an embodiment of a reel brake for a retractable reel system.
Figure 6B:
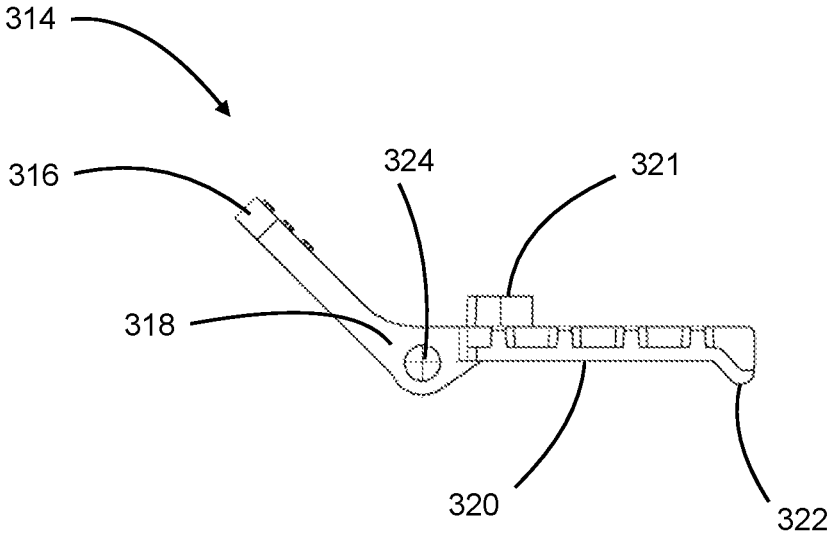

FIGS. 6A-6B illustrate views of an embodiment of a reel brake 314 for a retractable reel system 100. In the illustrated embodiment, a reel brake 314 includes a handle lever 316 attached to a base 318 of a u-shaped apparatus 320. U-shaped apparatus 320 includes downward facing protrusions 322 at both ends of u-shaped apparatus 320. Reel brake 314 pivots along an axis provided by a shoulder screw 324. Shoulder screw 324 is located between handle lever 316 and base 318 of the u-shaped apparatus 320. Reel brake 314 engages or disengages the downward facing protrusions 322 from upward facing notches 326 on opposing exterior sides 328 and 330 of the reel 302.

In the illustrated embodiment, reel brake 314 includes a spring holder 321 on the u-shaped apparatus 320 side of shoulder screw 324. A spring 325 acts to bias protrusions 322 to engage the upward facing notches 326 on the opposing exterior sides 328 and 330 of the reel 302 to act as a brake and stop the rotation of reel 302 in directions 308 and 310 (see also, FIGS. 3-5).

Figure 7:
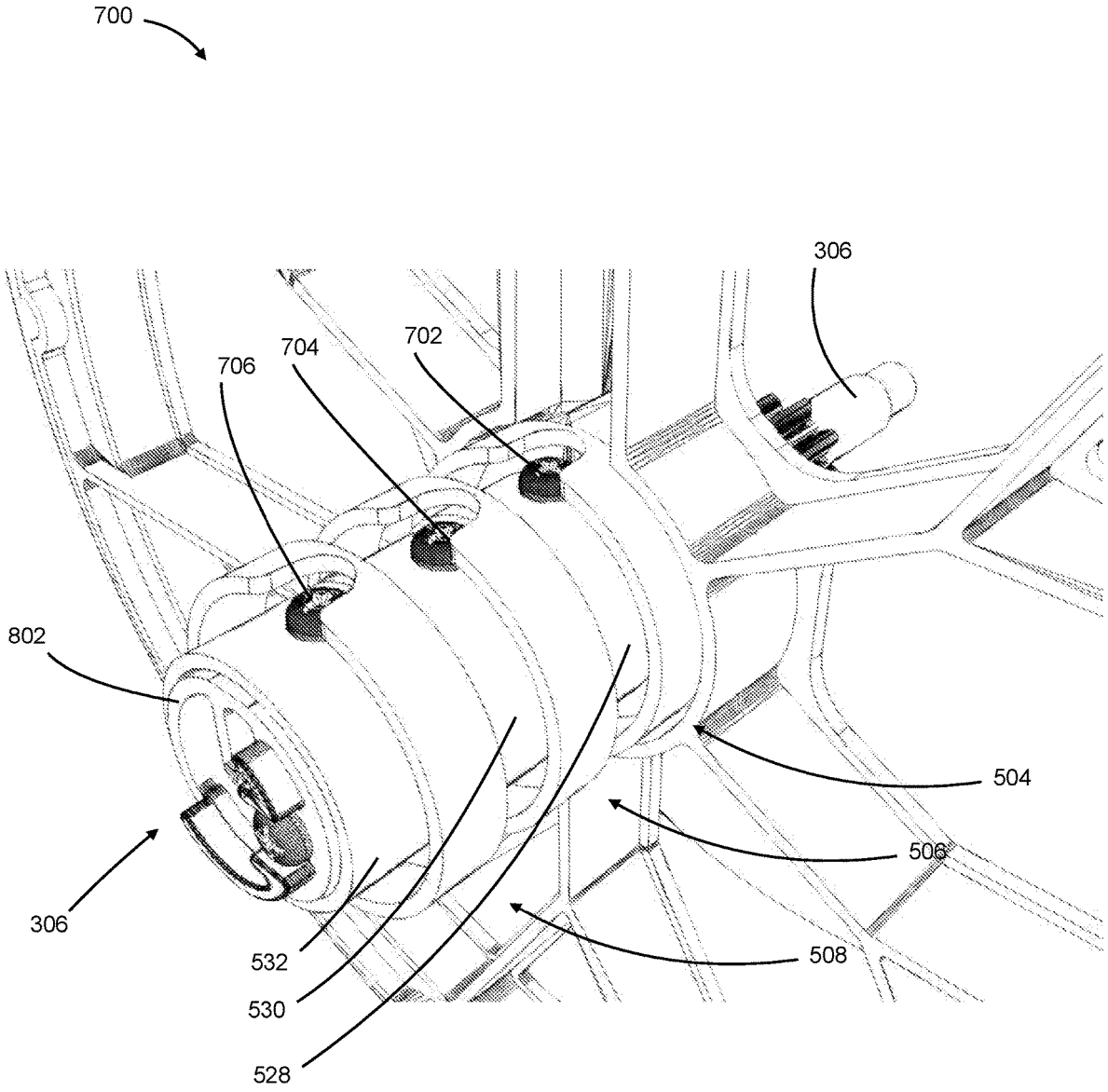
FIG. 7 illustrates a perspective view of an embodiment of a slip rings for a retractable reel system.

FIG. 7 illustrates a perspective view of an embodiment of slip rings at 700 for a retractable reel system 100. In the embodiment illustrated in FIG. 7, the three slip rings 504, 506 and 508 are arranged side-by-side on the wheel shaft 306. Slip rings 504, 506 and 508 are mounted to the wheel shaft 306, where slip rings 504, 506 and 508 are concentric with and rotate with the wheel shaft 306. Slip rings 504, 506 and 508 are electrically connected to electrical cord wires 510, 512 and 514 within the electrical cord 202. Each slip ring 504, 506 and 508 includes a rotor 802, a conductive rotor ring 528, 530 and 532 over a portion of the rotor, where the rotor rings 528, 530 and 532 are concentric with the wheel shaft 306. Each slip ring 504, 506 and 508 includes a retaining screw 702, 704 and 706 that secures the rotor ring 528, 530 and 532 to the rotor 802 to provide a conductive contact between each rotor ring 528, 530 and 532 and a terminal electrically connected to one of the positive electrical cord wire 510, the negative electrical cord wire 512 or the ground electrical cord wire 514 within the electrical cord.

For each of the slip rings 504, 506 and 508, rotor 802 holds the conductive rotor ring 528, 530 and 532 in place. Each retaining screw 702, 704 and 706 holds a ring terminal in place underneath (not shown). When the retaining screws 702, 704 and 706 are secured or tightened, they provide a good electrical contact from each conductive rotor ring 528, 530 and 532 to the corresponding ring terminal and the corresponding one of the positive electrical cord wire 510, the negative electrical cord wire 512 or the ground electrical cord wire 514 within the electrical cord 202.

Figure 8A:
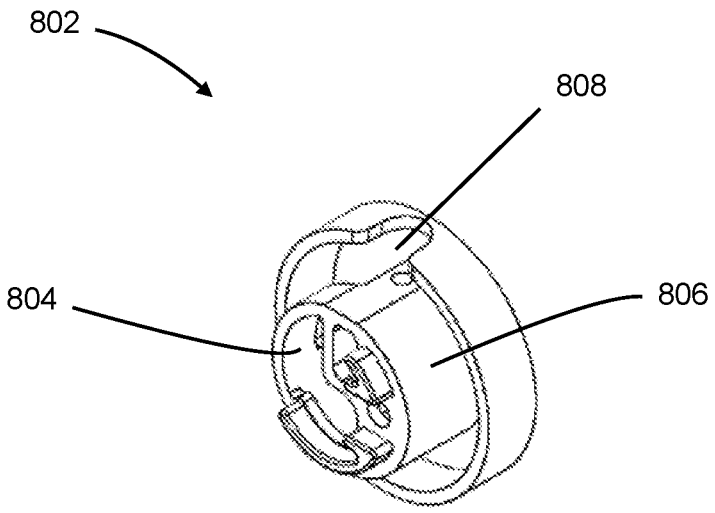
FIGS. 8A-8B illustrate views of an embodiment of a rotor for a retractable reel system.
Figure 8B:
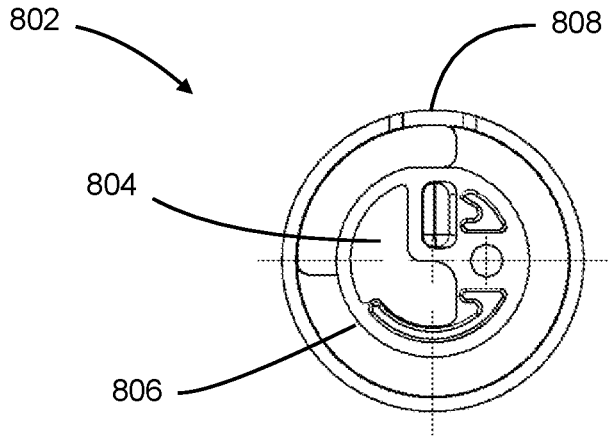

FIGS. 8A-8B illustrate perspective and side views of an embodiment of a rotor 802 for a retractable reel system 100. Each rotor 802 holds a conductive rotor ring 702, 704 and 706 in place over a surface illustrated at 806. Each retaining screw 708, 710 and 712 is accessible via opening 808 of rotor 802. Each of the positive electrical cord wire 510, the negative electrical cord wire 512 and the ground electrical cord wire 514 that connects to the ring terminal (not shown) for one of the conductive rotor rings 702, 704 and 706 and is routed through a center opening 804 of the rotor 802.

Figure 9:
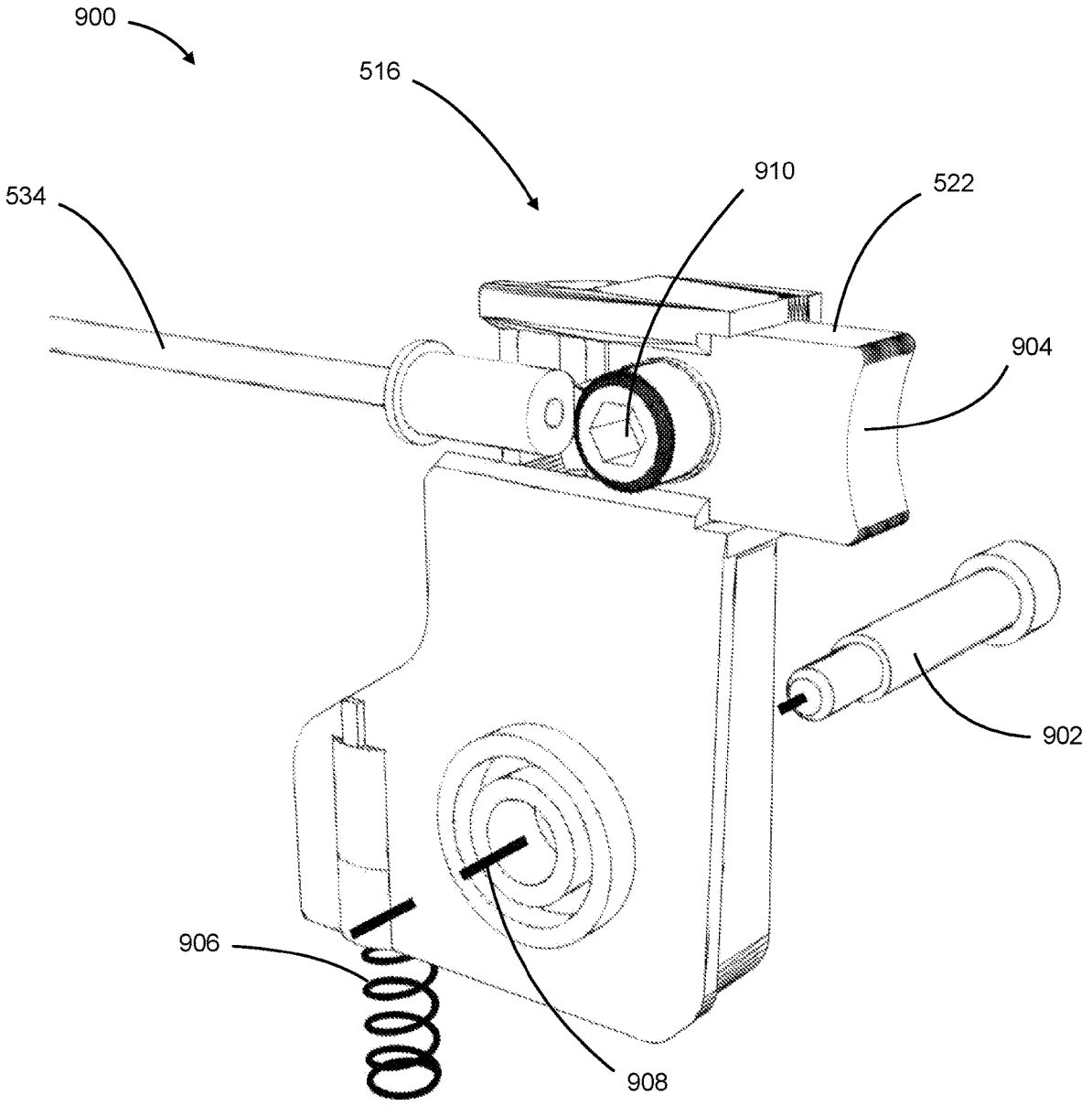
FIG. 9 illustrates a perspective view of an embodiment of a blade assembly for a retractable reel system.

FIG. 9 illustrates a perspective view of an embodiment of a blade assembly 900 for a retractable reel system 100. In the illustrated embodiment, each blade 900 corresponds to one of the three blades 516, 518 and 520 as illustrated in FIG. 5. For discussion purposes, reference will be made to blade 516. In the illustrated embodiment, all three blades 516, 518 and 520 have the same construction but with the exception that only one shoulder screw 902 is used for all three blades 516, 518 and 520. In other embodiments, each blade 516, 518 or 520 can use a unique shoulder screw 902.

In the illustrated embodiment, blade 516 includes a contact bar 522 that electrically contacts a corresponding slip ring 528 (see also, FIG. 5). Contact bar 522 is electrically connected to a corresponding extension cord wire 534 within extension cord 206. In various embodiments, contact bar 522 can be formed from any suitable conductive material such as copper. Blades 516, 518 and 520 are arranged side-by-side and pivot around shoulder screw 902. Blade 516 includes a spring 906 between lower portion 106 of outer case 102 and blade 522 to pivot blade 522 about an axis 908 provided by shoulder screw 902 to bias surface 904 of contact bar 522 against the corresponding rotor ring 528 for slip ring 504. Blade 516 includes a terminal screw 910 to electrically connect the contact bar 522 to extension cord wire 534 which represents one of the positive extension cord wire, the negative extension cord wire or the ground extension cord wire within the extension cord 206.

Figure 10:
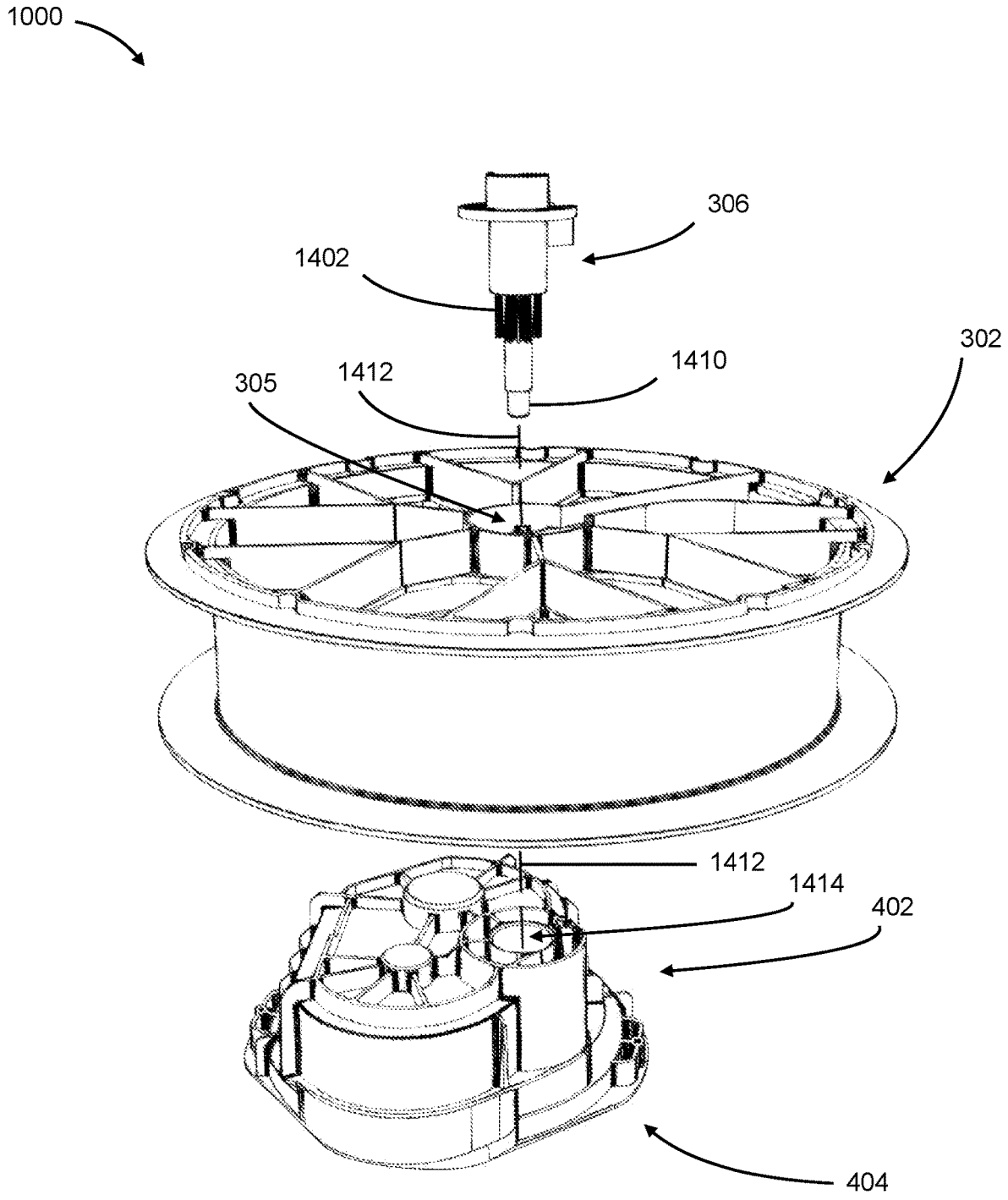
FIG. 10 illustrates an expanded view of an embodiment of a reel and cartridge assembly for a retractable reel system.

FIG. 10 illustrates an expanded view of an embodiment of a reel and cartridge assembly at 1000 for a retractable reel system 100. The embodiment illustrated in FIG. 10 includes a wheel shaft 306, a reel 302, a gear assembly 402 and a cartridge and spring assembly 404. Wheel shaft 306 includes an exterior driving gear 1402 on the wheel shaft 306 that engages a large idler gear 1404 (see also, FIG. 14). When assembled, wheel shaft 306 includes a tip 1410 that is inserted through hub 305 of reel 302 into port 1414 of gear assembly 402 so exterior driving gear 1402 can mesh and engage with large idler gear 1404 (see also, FIG. 14).

Figure 11A:
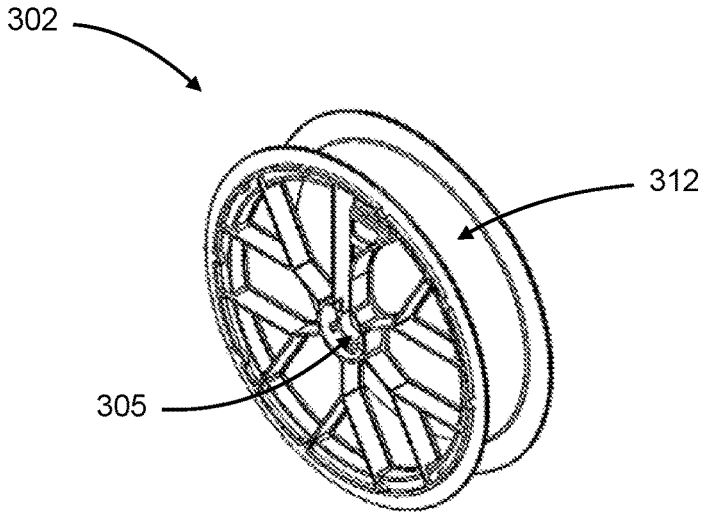
FIGS. 11A-11C illustrate views of an embodiment of a reel for a retractable reel system.
Figure 11B:
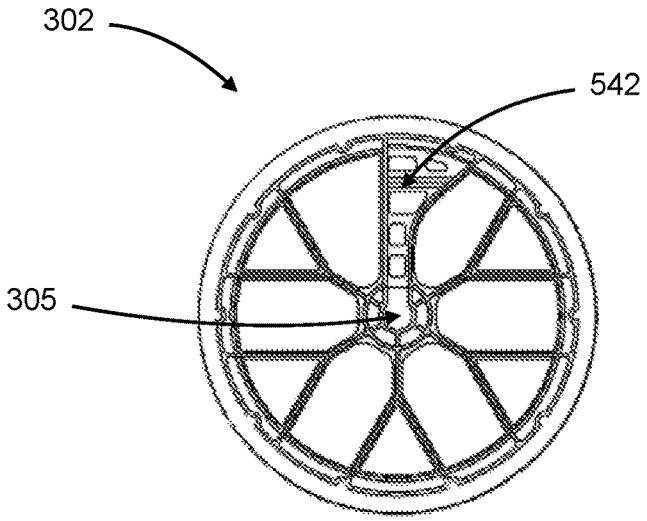
Figure 11C:
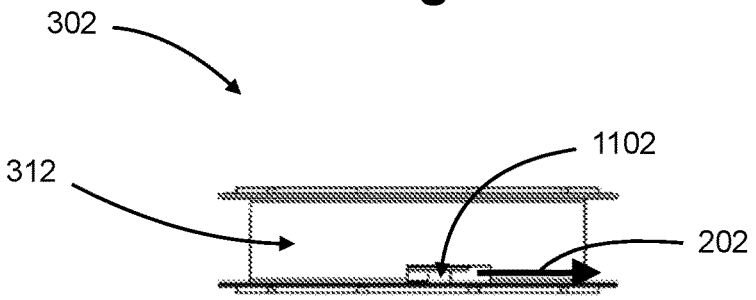

FIGS. 11A-11C illustrate perspective, side and top views of an embodiment of a reel 302 for a retractable reel system 100. In the illustrated embodiments, reel 302 includes a hub 305 and a routing channel 542 for electrical cord wires 510, 512 and 514 for electrical cord 202. Electrical cord 202 is routed through opening 1102 to be wound around reel 302 within channel 312 of reel 302 (see also, FIG. 3).

Figure 12A:
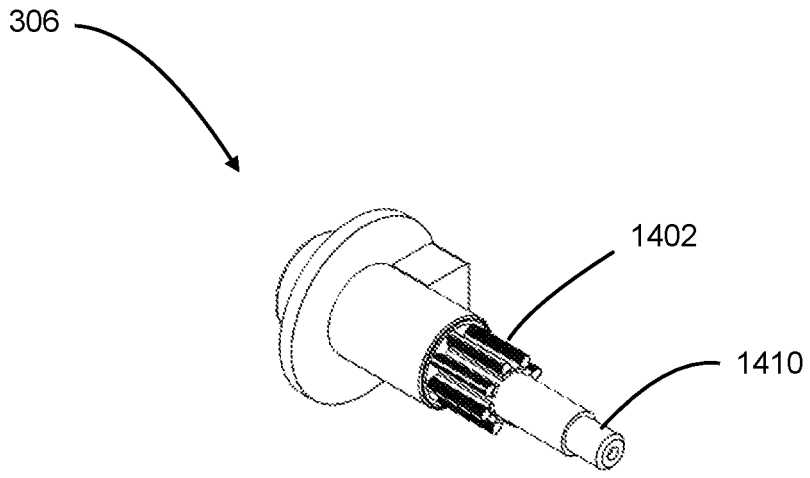
FIGS. 12A-12B illustrate views of an embodiment of a wheel shaft for a retractable reel system.
Figure 12B:
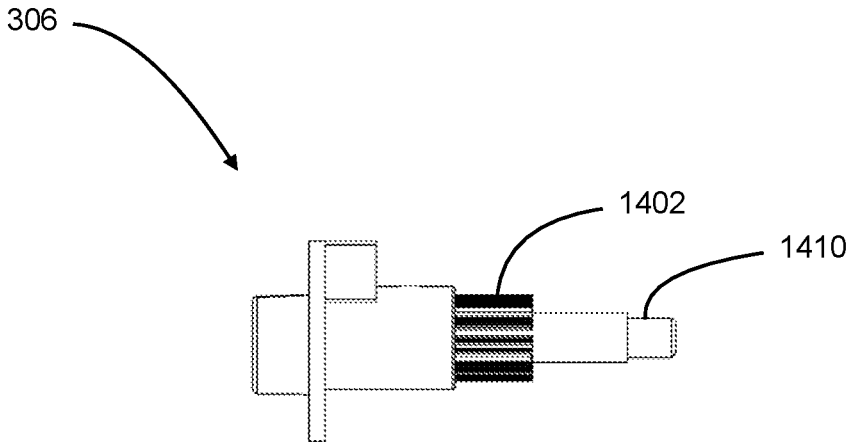

FIGS. 12A-12B illustrate perspective and side views of an embodiment of a wheel shaft 306 for a retractable reel system 100. In the illustrated embodiments, wheel shaft 306 includes a tip 1410 that is inserted through hub 305 of reel 302 into port 1414 of gear assembly 402 so exterior driving gear 1402 can mesh and engage with large idler gear 1404 (see also, FIG. 14).

Figure 13A:
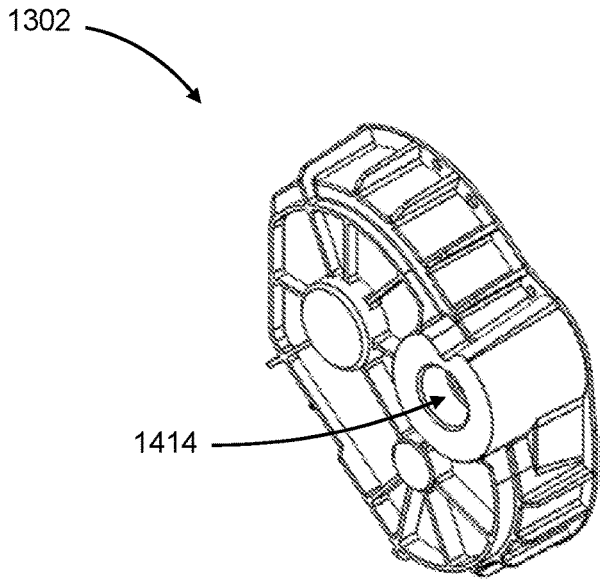
FIGS. 13A-13C illustrate views of an embodiment of a cartridge cover for a retractable reel system.
Figure 13B:
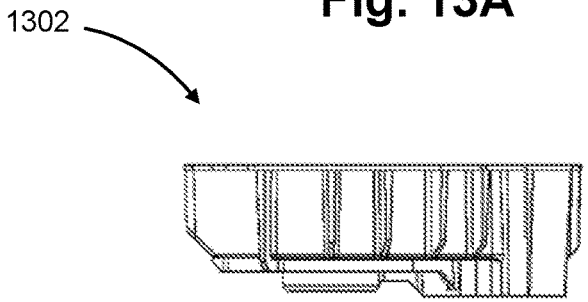
Figure 13C:
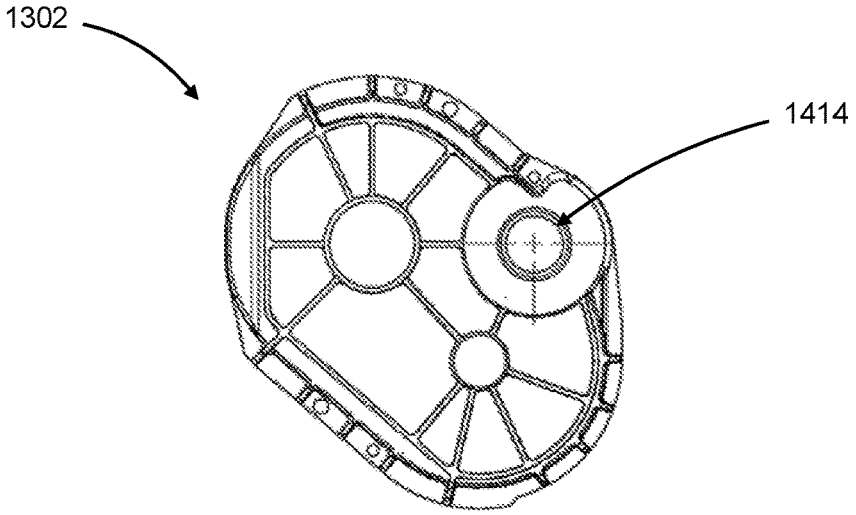

FIGS. 13A-13C illustrate, side and bottom views of an embodiment of a cartridge cover 1302 for a retractable reel system 100. In the illustrated embodiments, wheel shaft 306 includes a tip 1410 that is inserted through port 1414 of cartridge cover 1302. Cartridge cover 1302 houses gear assembly 402 between cartridge cover 1302 and cartridge base 1418 (see also, FIG. 14).

Figure 14:
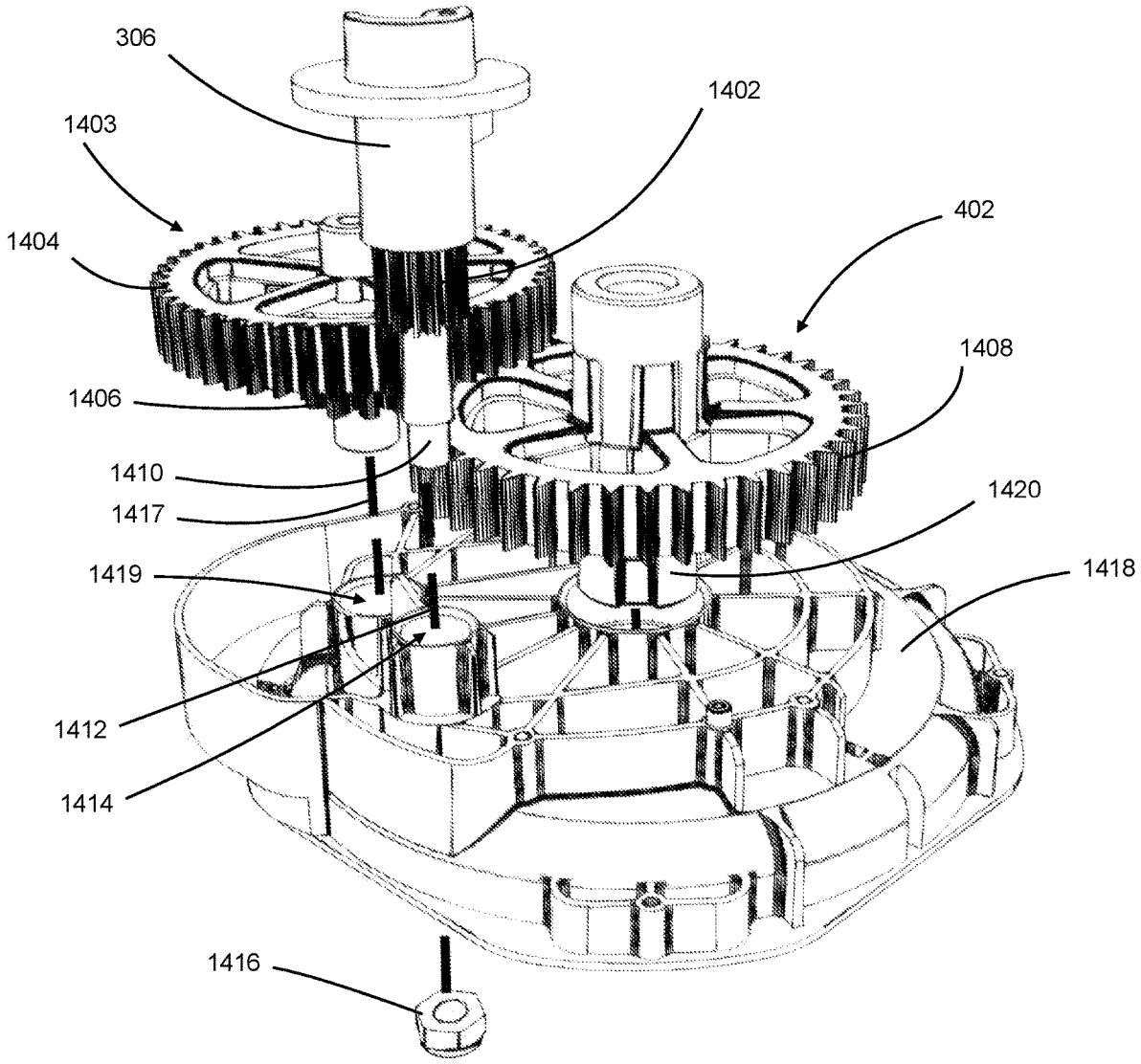
FIG. 14 illustrates an exploded view of an embodiment of a gear assembly for a retractable reel system.

FIG. 14 illustrates an exploded view of an embodiment of a gear assembly 402 for a retractable reel system 100. In the illustrated embodiment, gear assembly 402 is engaged with an end of the wheel shaft 306 which includes exterior driving gear 1402 to provide a gear reduction ratio between the wheel shaft 306 and an output shaft 1420 of the gear assembly 402. In one embodiment, the gear reduction ratio is within a range of about 10:1 to about 60:1. In other embodiments, the gear reduction ration can have other suitable ranges or values.

In the illustrated embodiment, gear assembly 402 includes a compound idler gear 1403 that includes a large idler gear 1404 and a small idler gear 1406. Gear assembly 402 includes a driven gear 1408 connected to and concentric with the output shaft 1420 of the gear assembly 402 that engages and meshes with the small idler gear 1406. Gear assembly 402 also includes an exterior driving gear 1402 on the wheel shaft 306 that engages and meshes with the large idler gear 1404.

In the illustrated embodiment, wheel shaft 306 includes a tip 1410 that is inserted into and is rotatable within port 1414 that is shown aligned with axis 1412 of cartridge base 1418 so exterior driving gear 1402 can mesh and engage with large idler gear 1404. Wheel shaft 306 is secured within cartridge base 1418 via a retaining nut 1416. An end of compound idler gear 1403 is inserted into and is rotatable within a port 1419 as shown along axis 1417 of cartridge base 1418 so exterior driving gear 1402 can mesh and engage with large idler gear 1404 and small idler gear 1406 can mesh and engage with driven gear 1408.

In the illustrated embodiment, a first gear reduction ration is defined between the driving gear 1402 and large idler gear 1404 and a second gear reduction ratio is defined between the small idler gear 1406 and the driven gear 1408. In this embodiment, the gear reduction ratio between the wheel shaft 306 and an output shaft 1420 of the gear assembly 402 is defined as a product of the first gear reduction ratio and the second gear reduction ratio.

Figure 15A:
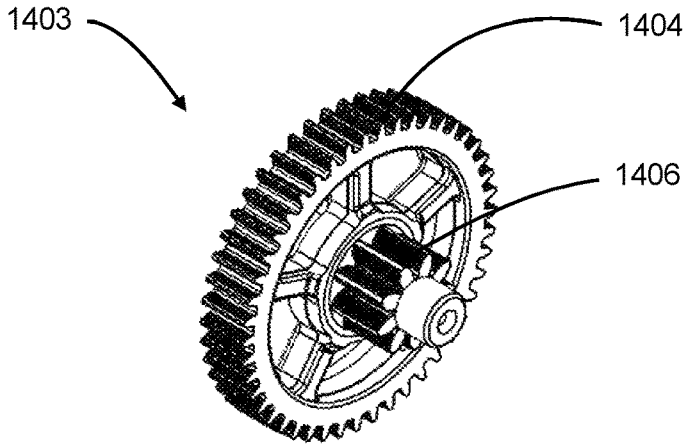
FIGS. 15A-15C illustrate views of an embodiment of a compound idler gear for a retractable reel system.
Figure 15B:
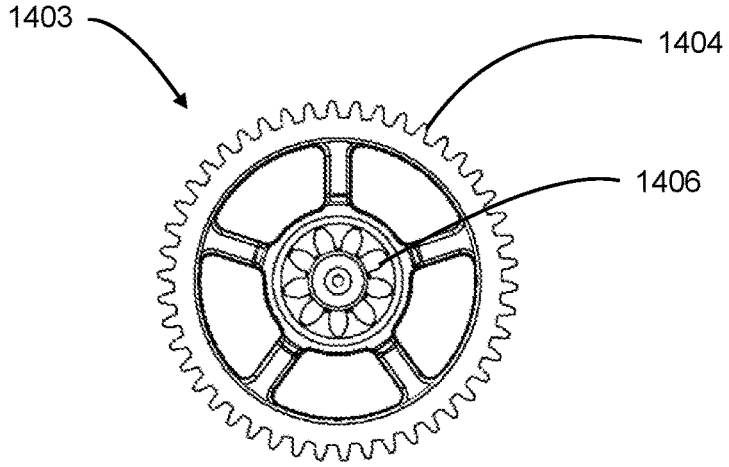
Figure 15C:
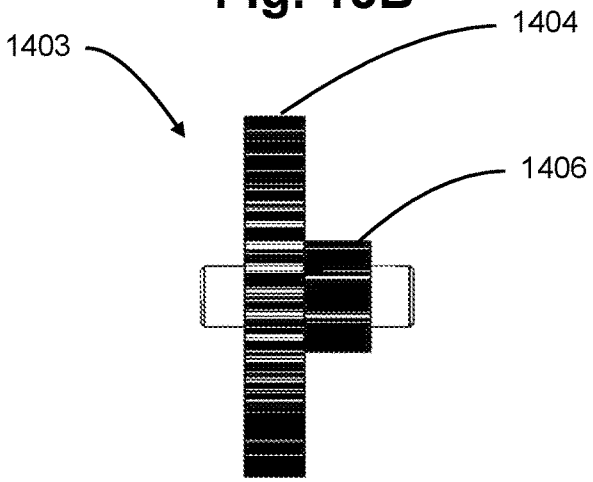

FIGS. 15A-15C illustrate perspective, side and top views of an embodiment of a compound idler gear 1403 for a retractable reel system 100. In the illustrated embodiments, compound idler gear 1403 includes a large idler gear 1404 and a small idler gear 1406 (see also, FIG. 14).

Figure 16A:
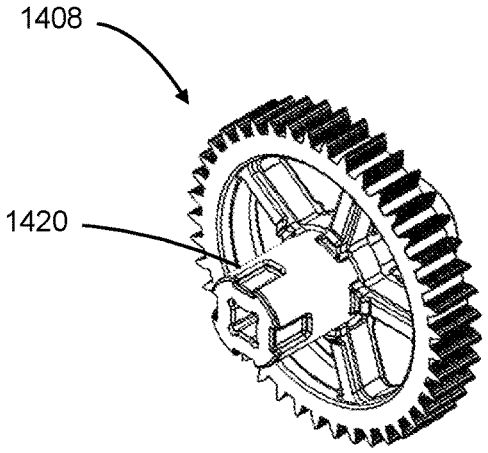
FIGS. 16A-16C illustrate views of an embodiment of a driven gear for a retractable reel system.
Figure 16B:
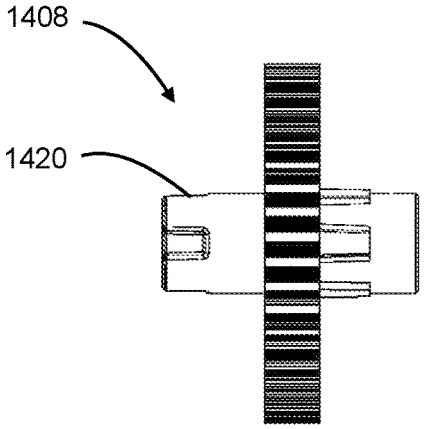
Figure 16C:
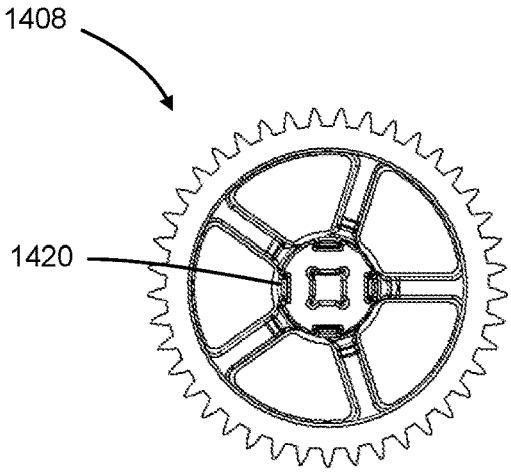

FIGS. 16A-16C illustrate perspective, side and top views of an embodiment of a driven gear 1408 for a retractable reel system 100. In the illustrated embodiments driven gear 1408 includes an output shaft 1420 (see also, FIG. 14).

Figure 17:
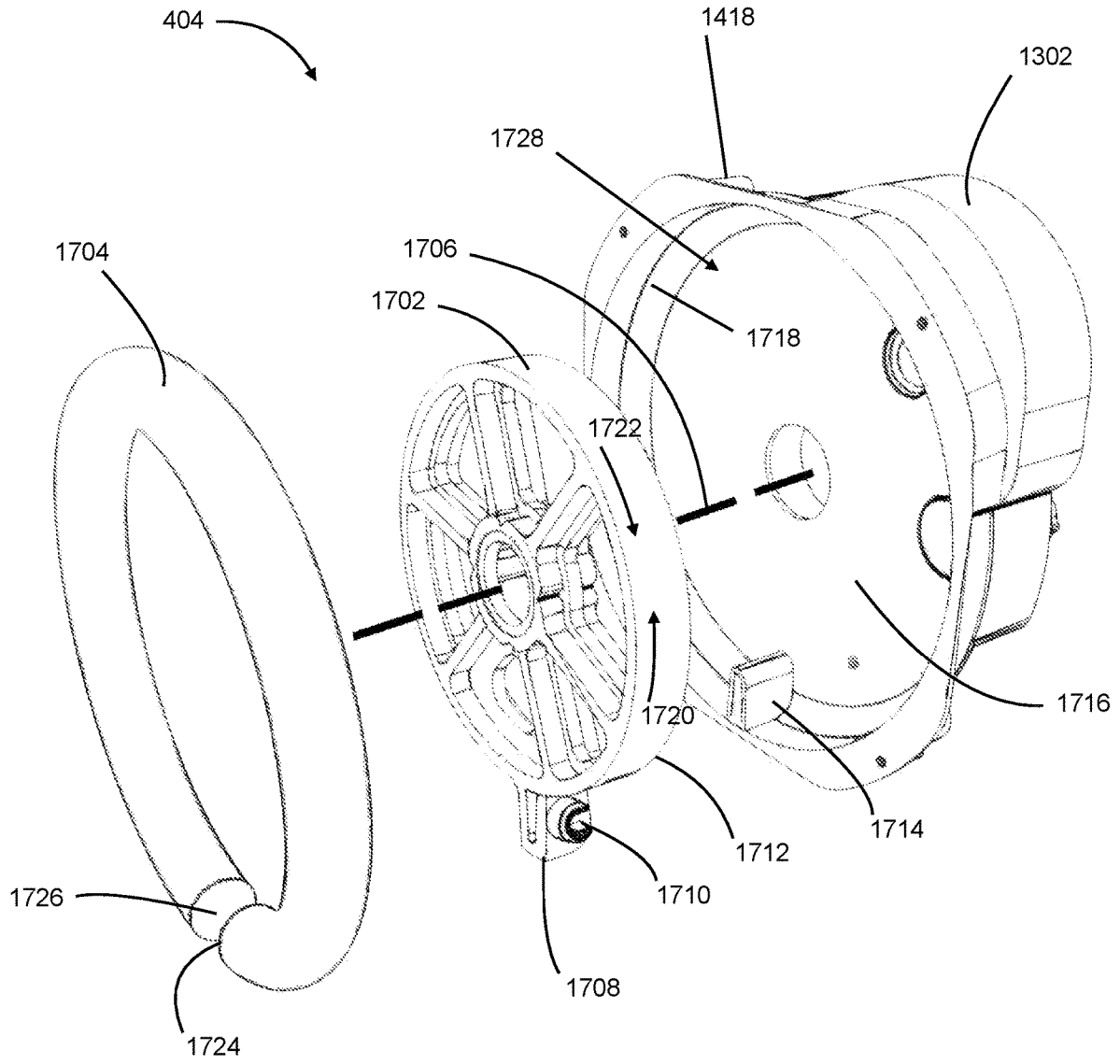
FIG. 17 illustrates an exploded view of an embodiment of a cartridge base, a paddle wheel and a spring for a retractable reel system.
Figure 18:
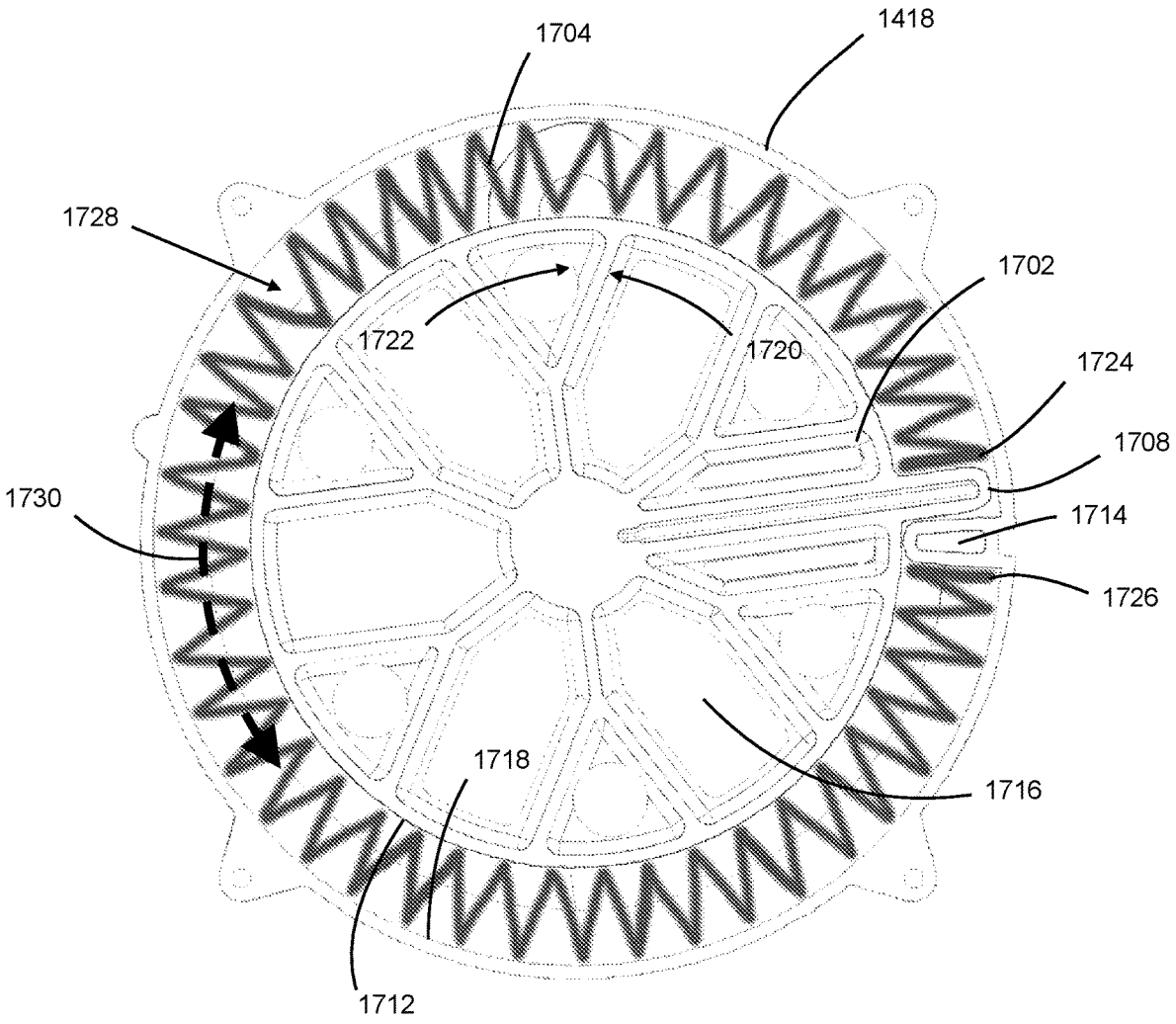
FIG. 18 illustrates an end view of an embodiment of a cartridge base, a paddle wheel and a spring for a retractable reel system.

FIG. 17 illustrates an exploded view of an embodiment of a cartridge base 1418, a paddle wheel 1702 and a spring 1704 for a retractable reel system 100. FIG. 18 illustrates an end view of an embodiment of a cartridge base 1418, a paddle wheel 1702 and a spring 1704 for a retractable reel system 100. Referring to FIGS. 17 and 18, cartridge and spring assembly 404 is mounted inside the outer case 102 (see also, FIGS. 1 and 2). Cartridge base 1418 includes an outer sidewall 1718 around an interior planar base 1716 of cartridge base 1418 and further includes a spring stop 1714 that extends inward from the outer sidewall 1718. The paddle wheel 1702 is positioned interior to the outer sidewall 1718 and the spring 1704 is positioned within a channel 1728 formed between the outer edge 1712 of the paddle wheel 1702 and the sidewall 1718 of the cartridge base 1716. The spring 1704 is compressed or decompressed between the paddle 1708 and the spring stop 1714 within channel 1728.

In the illustrated embodiment, spring 1704 is an open-coil helical spring 1704 that opposes compression, and spring 1704 is within channel 1728 that is circumferential. Spring 1704 is compressed between the paddle 1708 and the spring stop 1714 in a direction that is radial to a center of rotation of the paddle wheel 1702 and spring holder 1710. Cartridge base 1418 does not rotate. Center 1730 illustrates a circumferential center of spring 1704 within channel 1728 and also represents a circumferential center of channel 1728. In the illustrated embodiment, center 1730 represents a midpoint or center of a thickness of spring 1704 between outer edge 1712 of the paddle wheel 1702 and sidewall 1718 of cartridge base 1716.

In the illustrated embodiment, paddle wheel 1702 is connected to and concentric with the output shaft 1420 of the driven gear 1408. Paddle wheel 1702 includes a paddle 1708 that extends beyond an outer edge 1712 of paddle wheel 1702 and rotates with the paddle wheel 1702. Spring 1704 is arranged outside the outer edge 1712 of the paddle wheel 1702 and the first end 1724 of spring 1704 is engaged by paddle 1708 and the second end 1726 of spring 1704 abuts against and is held from movement by spring stop 1714. Spring 1704 is compressed in the first direction 1720 by paddle 1708 when paddle wheel 1702 rotates in the first direction 1720 to store an energy when the reel 302 is rotated in direction 310 to unwind the length of electrical cord 202 from the reel 302. Paddle wheel 1702 can compress spring 1704 in the first direction 1720 by paddle 1708 up until the point where spring 1704 is fully compressed. Spring 1704 is decompressed in the second direction 1722 when paddle wheel 1702 rotates in the second direction 1722 to use the energy stored within compressed spring 1704 between spring stop 1714 and paddle 1708 to rotate paddle wheel 1702 in the second direction 1722 to wind the length of electrical cord 202 on the reel when the reel is rotated in direction 308. Gear assembly 402 provides a gear reduction ratio between the wheel shaft 306 and an output shaft 1420 of the gear assembly 402 when spring 1704 is compressed in the first direction 1720 by paddle 1708, and provides the opposite of the gear reduction ratio when output shaft 1420 is rotated by paddle wheel 1702 in the second direction 1722. In the illustrated embodiment, reel brake 314 may engage or disengage the downward facing protrusions 322 from upward facing notches 326 on opposing exterior sides 328, 330 of the reel 302 respectively, to stop or enable rotation of reel 302 to stop or enable paddle wheel 1702 to rotate in either the first direction 1720 or the second direction 1722.

In one embodiment, paddle wheel 1702 connected to and concentric with the output shaft 1420, and paddle wheel 1702 includes a paddle 1708 that extends beyond an outer edge 1712 of the paddle wheel 1702 and rotates with the paddle wheel 1702. Spring 1704 is arranged outside the outer edge 1712 of the paddle wheel 1702 and is compressed by the paddle 1708 to store an energy when the reel 302 is rotated to unwind the length of electrical cord from the reel 302, and spring 1704 is decompressed to use the stored energy to rotate the reel 302 to wind the length of electrical cord around the reel 302.

Table 1 illustrates two exemplary embodiments for gear ratios and spring compression rates for a retractable reel system 100.

TABLE 1

| | First Embodiment | Second Embodiment |
|---|---|---|
| Gear Reduction Ratio | 20:1 | 26.2:1 |
| Length of Electrical Cord 202 Unwound from Reel 302 | 13.3' | 21.7' |
| Rotations of Reel 302 to Unwind Electrical Cord 202 | 6 | 9 |
| Spring Compression Rate | 4.6 Lbs./In | 6.66 Lbs./In |
| Paddle Wheel 1702 Radius To Center 1730 of Spring 1704* | 2.418" | 2.387" |
| Driven Gear 1408 No. of Teeth | 48T | 41T |
| Driven Gear 1408 Base Circle Diameter | 2.904" | 3.231" |
| Large Idler Gear 1404 No. of Teeth | 40T | 46T |
| Large Idler Gear 1404 Base Circle Diameter | 2.420" | 2.783" |
| Small Idler Gear 1406 No. of Teeth | 12T | 9T |
| Small Idler Gear 1406 Base Circle Diameter | 0.726" | 0.709" |
| Exterior Driving gear 1402 No. of Teeth | 8T | 8T |
| Exterior Driving gear 1402 Base Circle Diameter | 0.484" | 0.484" |
| Average Reel 302 Diameter** | 8.46" | 9.2" |

*Center 1730 represents a midpoint or center of a thickness of spring 1704.

**An average reel 302 diameter is used because the length of material or electrical cord 202 wound around the reel 302 lays on the reel in two rows.

Table 1 illustrates a first embodiment where exterior driving gear 1402 includes 8 gear teeth and large idler gear 1404 includes 40 gear teeth, which provides a gear reduction ratio between exterior driving gear 1402 and large idler gear 1404 of 8 teeth/40 teeth which is equal to a first gear reduction ratio of 0.2. Small idler gear 1406 includes 12 gear teeth and driven gear 1408 includes 48 gear teeth, which provides a gear reduction ratio between small idler gear 1406 and driven gear 1408 of 12 teeth/48 teeth which is equal to a second gear reduction ration of 0.25. For the first embodiment, the overall gear reduction ratio is defined as a product of the first gear reduction ratio of 0.2 and the second gear reduction ratio of 0.25 which is equal to 0.05 or an overall gear reduction ratio of 20:1.

Table 1 illustrates a second embodiment where exterior driving gear 1402 includes 8 gear teeth and large idler gear 1404 includes 46 gear teeth, which provides a gear reduction ratio between exterior driving gear 1402 and large idler gear 1404 of 8 teeth/46 teeth which is equal to a first gear reduction ratio of 0.17. Small idler gear 1406 includes 9 gear teeth and driven gear 1408 includes 41 gear teeth, which provides a gear reduction ratio between small idler gear 1406 and driven gear 1408 of 9 teeth/41 teeth which is equal to a second gear reduction ration of 0.22. For the second embodiment, the overall gear reduction ratio is defined as a product of the first gear reduction ratio of 0.17 and the second gear reduction ratio of 0.22 which is equal to 0.038 or an overall gear reduction ratio of 26.2:1.

The detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIGS. 1 through 19. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

With the above range of variations and applications in mind, it should be understood that the present invention is not limited by the foregoing description, nor is it limited by the accompanying drawings. Instead, the present invention is limited only by the following claims and their legal equivalents.

What is claimed is:

1. A retractable reel system, comprising:

a reel having a concentric wheel shaft, wherein the reel and the wheel shaft rotate to wind and unwind a length of material from the reel;

a gear assembly engaged with an end of the wheel shaft to provide a gear reduction ratio between the wheel shaft and an output shaft of the gear assembly;

a paddle wheel connected to and concentric with the output shaft, the paddle wheel having a paddle that extends beyond an outer edge of the paddle wheel and rotates with the paddle wheel; and a spring arranged outside the outer edge of the paddle wheel, wherein the spring is compressed by the paddle to store an energy when the reel is rotated to unwind the length of material from the reel, and wherein the energy is used to rotate the reel to wind the length of material around the reel.

2. The retractable reel system of claim 1, wherein the gear assembly comprises:

a compound idler gear that includes a large idler gear and a small idler gear;

a driven gear connected to and concentric with the output shaft of the gear assembly that engages the small idler gear; and an exterior driving gear on the wheel shaft of the reel that engages the large idler gear, wherein the gear reduction ratio is defined between the wheel shaft and the output shaft of the gear assembly.

3. The retractable reel system of claim 2, wherein a first gear reduction ratio is defined between the driving gear and the large idler gear, a second gear reduction ratio is defined between the small idler gear and the driven gear, and wherein the gear reduction ratio is defined as a product of the first gear reduction ratio and the second gear reduction ratio.

4. The retractable reel system of claim 1, wherein the gear reduction ratio is within a range of about 10:1 to about 60:1.

5. The retractable reel system of claim 1, further comprising a cartridge base that includes an outer sidewall around an interior planar base and a spring stop that extends inward from the outer sidewall, wherein the paddle wheel is positioned interior to the outer sidewall and the spring is positioned within a channel formed between the outer edge of the paddle wheel and the outer sidewall of the cartridge base, and wherein the spring is compressed between the paddle and the spring stop within the channel.

6. The retractable reel system of claim 5, wherein the spring is an open-coil helical spring that opposes compression, and wherein the channel is circumferential and the spring is compressed between the paddle and the spring stop in a direction that is radial to a center of rotation of the paddle wheel.

7. The retractable reel system of claim 1, further comprising a reel brake that includes a handle lever attached to a base of a u-shaped apparatus having downward facing protrusions at ends of the u-shaped apparatus, wherein the reel brake pivots along an axis transverse to a direction of rotation of the reel that is between the handle lever and the base of the u-shaped apparatus, the reel brake configured to engage or disengage the downward facing protrusions from upward facing notches on opposing exterior sides of the reel.

8. The retractable reel system of claim 1, wherein the material is one of an electrical cord, a pneumatic hose, a water hose, a leash or a measuring tape.

9. A retractable electrical cord system, comprising:

a reel having a concentric wheel shaft, wherein the reel and the wheel shaft rotate to wind and unwind a length of an electrical cord from the reel;

a gear assembly that provides a gear reduction ratio between the wheel shaft and an output shaft of the gear assembly; and a cartridge and a spring assembly that includes a paddle wheel connected to and concentric with the output shaft, the paddle wheel including a paddle that extends beyond an outer edge of the paddle wheel and rotates with the paddle wheel, wherein a spring is arranged outside the outer edge of the paddle wheel and is compressed by the paddle to store an energy when the reel is rotated to unwind the length of the electrical cord from the reel, and wherein the spring is decompressed to use the stored energy to rotate the reel to wind the length of the electrical cord around the reel.

10. The retractable electrical cord system of claim 9, wherein the gear assembly comprises:

a compound idler gear that includes a large idler gear and a small idler gear;

a driven gear connected to and concentric with the output shaft of the gear assembly that engages the small idler gear; and an exterior driving gear on the wheel shaft of the reel that engages the large idler gear, wherein the gear reduction ratio is defined between the wheel shaft and the output shaft of the gear assembly.

11. The retractable electrical cord system of claim 9, wherein the gear reduction ratio is within a range of about 10:1 to about 60:1.

12. The retractable electrical cord system of claim 9, wherein the spring is an open-coil helical spring that opposes compression.

13. The retractable electrical cord system of claim 9, further comprising a reel brake that includes a handle lever attached to a base of a u-shaped apparatus having downward facing protrusions at ends of the u-shaped apparatus, wherein the reel brake pivots along an axis transverse to a direction of rotation of the reel that is between the handle lever and the base of the u-shaped apparatus, the reel brake configured to engage or disengage the downward facing protrusions from upward facing notches on opposing exterior sides of the reel.

14. The retractable electrical cord system of claim 13, wherein the reel brake comprises a spring adapted to bias the protrusions to engage the upward facing notches on the opposing exterior sides of the reel.

15. A retractable electrical cord system, comprising:

an outer case that includes a slot;

a reel mounted inside the outer case, the reel having a concentric wheel shaft, wherein the reel and the wheel shaft rotate to wind and unwind a length of an electrical cord from the reel through the slot;

a gear assembly mounted inside the outer case, the gear assembly providing a gear reduction ratio between the wheel shaft and an output shaft of the gear assembly; and a cartridge and spring assembly mounted inside the outer case and including a paddle wheel connected to and concentric with the output shaft, the paddle wheel including a paddle that extends beyond an outer edge of the paddle wheel and rotates with the paddle wheel, wherein a spring is arranged outside the outer edge of the paddle wheel and is compressed by the paddle to store an energy when the reel is rotated to unwind the length of the electrical cord from the reel, and wherein the spring is decompressed to use the stored energy to rotate the reel to wind the length of the electrical cord around the reel.

16. The retractable electrical cord system of claim 15, further comprising an accessory light mounted to an exterior of the outer case.

17. The retractable electrical cord system of claim 15, wherein the spring is an open-coil helical spring that opposes compression.

18. The retractable electrical cord system of claim 15, further comprising a reel brake that includes a handle lever attached to a base of a u-shaped apparatus having downward facing protrusions at ends of the u-shaped apparatus, wherein the reel brake pivots along an axis transverse to a direction of rotation of the reel that is between the handle lever and the base of the u-shaped apparatus, the reel brake configured to engage or disengage the downward facing protrusions from upward facing notches on opposing exterior sides of the reel.

19. The retractable electrical cord system of claim 18, wherein the reel brake comprises a spring adapted to bias the protrusions to engage the upward facing notches on the opposing exterior sides of the reel.

20. The retractable electrical cord system of claim 15, further comprising a cartridge base that includes an outer sidewall around an interior planar base and a spring stop that extends inward from the outer sidewall, wherein the paddle wheel is positioned interior to the outer sidewall and the spring is positioned within a channel formed between the outer edge of the paddle wheel and the outer sidewall of the cartridge base, and wherein the spring is compressed and decompressed within the channel between the paddle and the spring stop.

* * * * *